US008813266B1

(12) United States Patent
Green

(10) Patent No.: US 8,813,266 B1
(45) Date of Patent: Aug. 26, 2014

(54) ANCHORED GARMENT ASSEMBLY

(76) Inventor: Donald Green, Camden, AR (US)

( * ) Notice: Subject to any disclaimer, the term of this patent is extended or adjusted under 35 U.S.C. 154(b) by 328 days.

(21) Appl. No.: 13/405,355

(22) Filed: Feb. 26, 2012

(51) Int. Cl.
*A41F 7/00* (2006.01)

(52) U.S. Cl.
CPC ..... *A41F 7/00* (2013.01)
USPC ..... 2/400; 2/229; 2/230; 2/315

(58) Field of Classification Search
CPC ..... A41F 7/00
USPC ..... 2/78.4, 112, 107, 70, 230, 229, 300, 2/307, 304, 223, 217, 69, 227, 228, 236, 2/238, 311–315, 317, 323, 340, 400, 402, 2/403, 404, 407
See application file for complete search history.

(56) References Cited

U.S. PATENT DOCUMENTS

| | | | | | |
|---|---|---|---|---|---|
| 148,193 | A | * | 3/1874 | Dunbar | 2/229 |
| 265,524 | A | * | 10/1882 | Lyon | 2/229 |
| 321,654 | A | * | 7/1885 | Stark | 2/229 |
| 715,248 | A | * | 12/1902 | Davis | 2/75 |
| 932,640 | A | * | 8/1909 | Pfiffner | 2/70 |
| 1,107,158 | A | * | 8/1914 | Day | 2/236 |
| 1,159,439 | A | * | 11/1915 | Walker | 2/70 |
| 1,883,341 | A | * | 10/1932 | Dauphinais | 2/404 |
| 2,034,312 | A | * | 3/1936 | Rubin | 2/228 |
| 2,034,313 | A | | 3/1936 | Russell | |
| 4,110,845 | A | * | 9/1978 | Chellis | 36/2 R |
| 4,697,286 | A | * | 10/1987 | Cho | 2/22 |
| 4,888,830 | A | * | 12/1989 | Putnam | 2/327 |
| 5,689,832 | A | | 11/1997 | Head | |
| 6,202,220 | B1 | | 3/2001 | Rhoden | |
| 6,308,338 | B1 | | 10/2001 | Caldwell | |
| 6,654,962 | B2 | * | 12/2003 | DeMott | 2/22 |
| 6,698,031 | B2 | * | 3/2004 | Lewis | 2/340 |
| 6,922,849 | B1 | | 8/2005 | Fedrick | |
| 7,124,448 | B2 | | 10/2006 | Davenport | |
| D552,328 | S | | 10/2007 | Smith et al. | |
| D577,878 | S | * | 10/2008 | Perrine et al. | D2/742 |
| D595,029 | S | | 6/2009 | Diermayer et al. | |
| 7,596,816 | B1 | | 10/2009 | Henry et al. | |
| D609,431 | S | | 2/2010 | Perez et al. | |
| 8,074,298 | B2 | * | 12/2011 | Davenport | 2/227 |
| D658,850 | S | * | 5/2012 | Valentine | D2/624 |
| D689,260 | S | * | 9/2013 | Barnes | D2/742 |
| 8,607,367 | B2 | * | 12/2013 | Jones | 2/400 |
| 2004/0163159 | A1 | * | 8/2004 | Edwards et al. | 2/338 |
| 2007/0245463 | A1 | * | 10/2007 | Kang | 2/403 |
| 2009/0210996 | A1 | * | 8/2009 | Hu | 2/228 |

FOREIGN PATENT DOCUMENTS

WO WO 2008/142282 A2 * 11/2008

* cited by examiner

*Primary Examiner* — Amy Vanatta

(57) ABSTRACT

An anchored garment assembly is provided for holding an outer garment in a suspended position relative to an inner garment. The assembly includes an inner garment having a waistband and a pair of leg openings. A support loop is coupled to the inner garment. An outer garment has a top edge and a pair of leg portions extending downwardly from the top edge. A first strap has a first end, a second end, and a medial portion extending between the first end and the second end. The first end of the first strap is coupled to the outer garment. The medial portion of the first strap extends through the support loop. The second end is coupled to the outer garment whereby the top edge of the outer garment is supported by the first strap in spaced relationship to the waistband of the inner garment.

10 Claims, 7 Drawing Sheets

ANCHORED GARMENT ASSEMBLY

BACKGROUND OF THE DISCLOSURE

1. Field of the Disclosure

The disclosure relates to garment support devices and more particularly pertains to a new garment support device for holding an outer garment in a suspended position relative to an inner garment.

2. Summary of the Disclosure

An embodiment of the disclosure meets the needs presented above by generally comprising an inner garment having a waistband and a pair of leg openings. A support loop is coupled to the inner garment. An outer garment has a top edge and a pair of leg portions extending downwardly from the top edge. A first strap has a first end, a second end, and a medial portion extending between the first end and the second end. The first end of the first strap is coupled to the outer garment. The medial portion of the first strap extends through the support loop. The second end is coupled to the outer garment whereby the top edge of the outer garment is supported by the first strap in spaced relationship to the waistband of the inner garment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
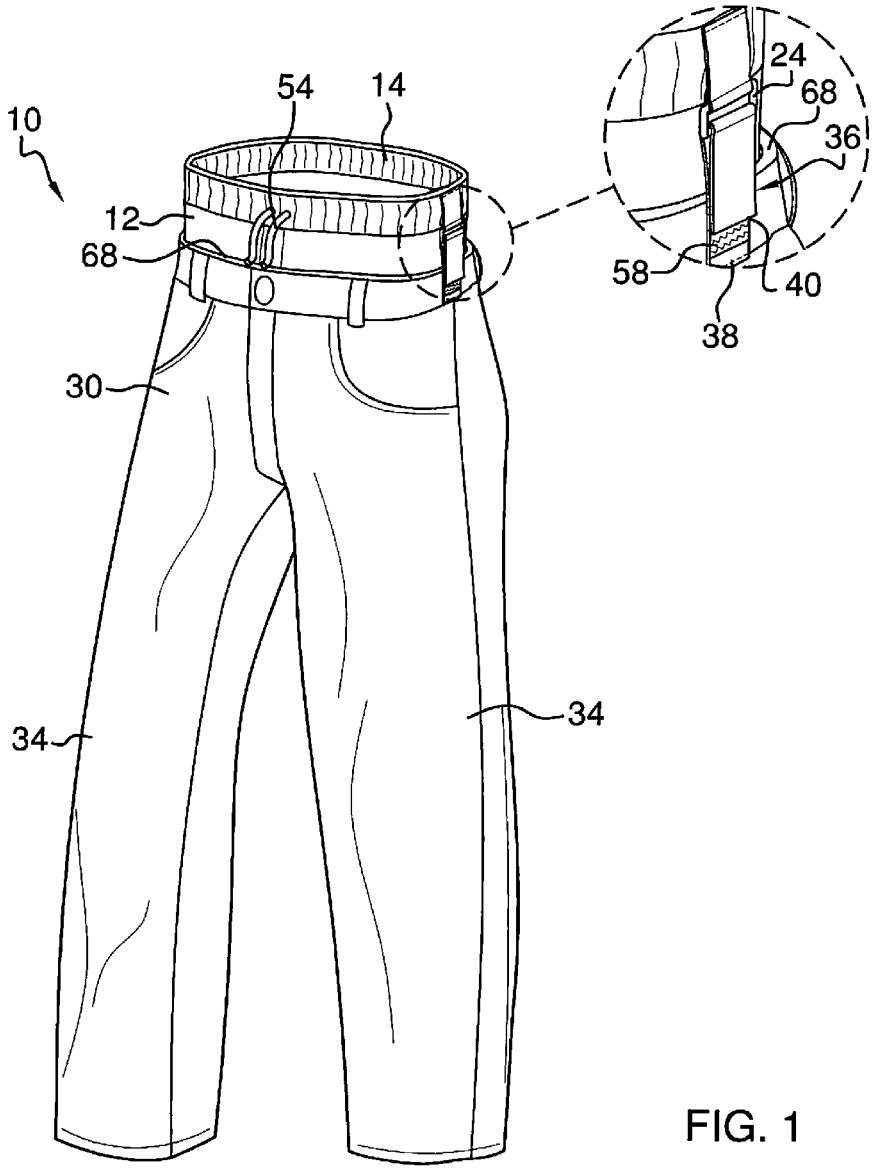
FIG. 1 is a top front side perspective view of a anchored garment assembly according to an embodiment of the disclosure.
Figure 2:
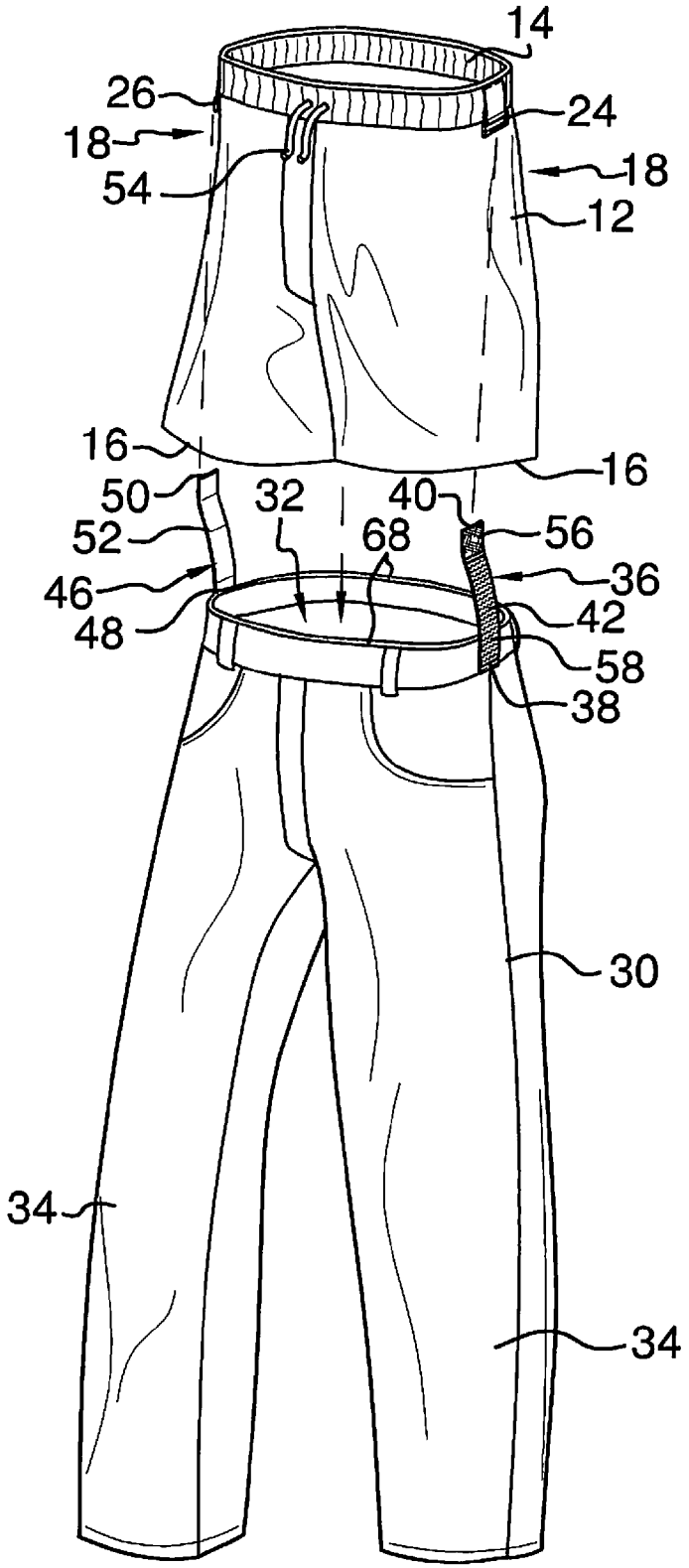
FIG. 2 is an exploded top front side perspective view of an embodiment of the disclosure.
Figure 3:
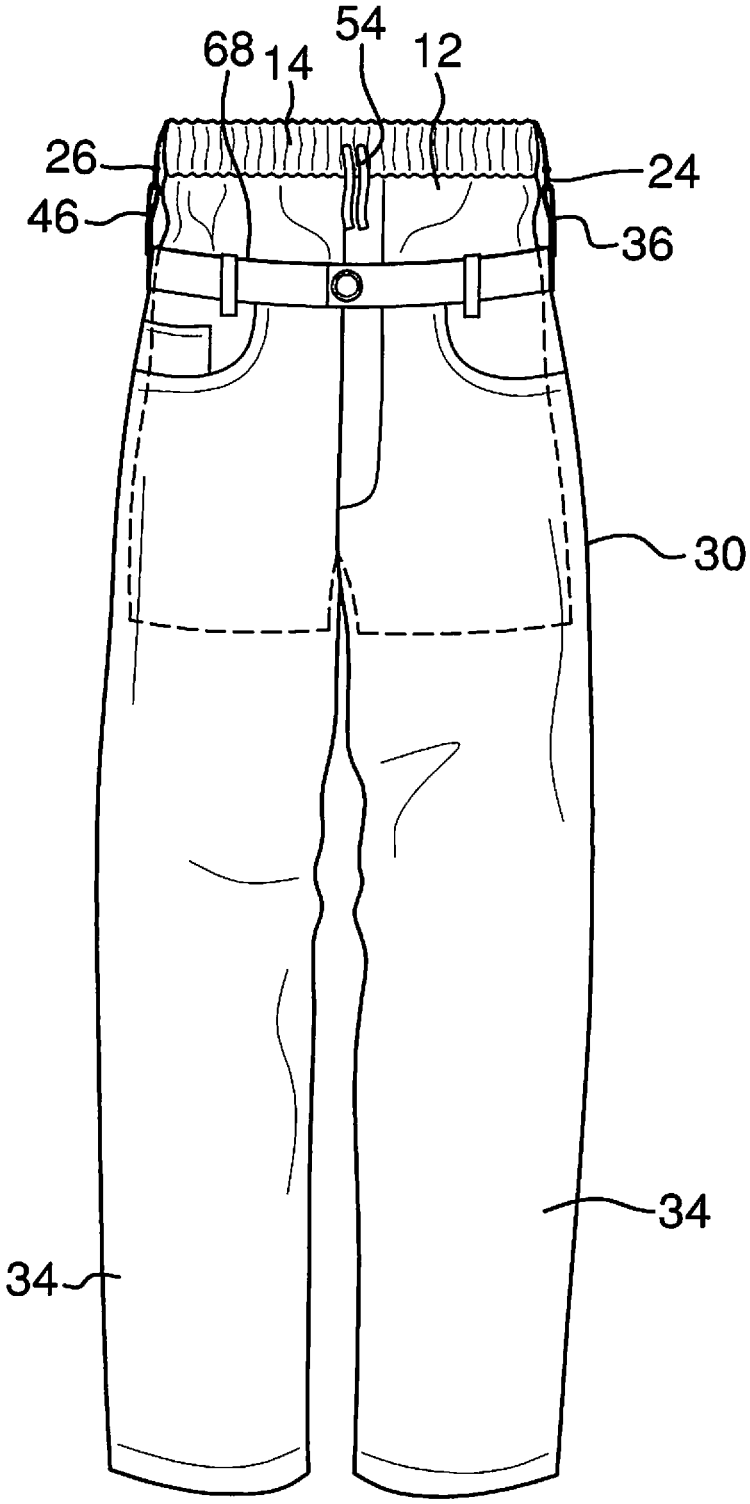
FIG. 3 is a front view of an embodiment of the disclosure.
Figure 4:
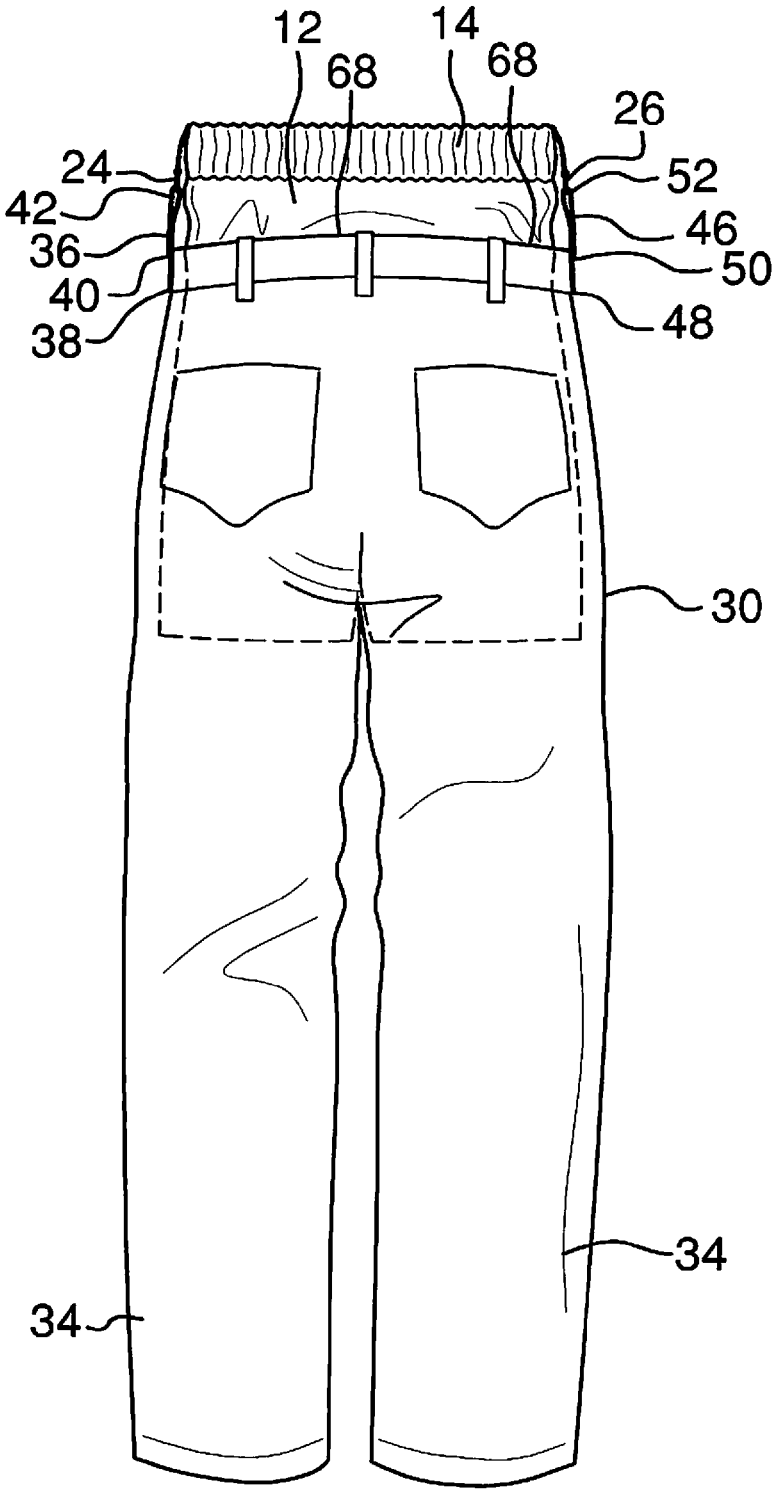
FIG. 4 is a back view of an embodiment of the disclosure.
Figure 5:
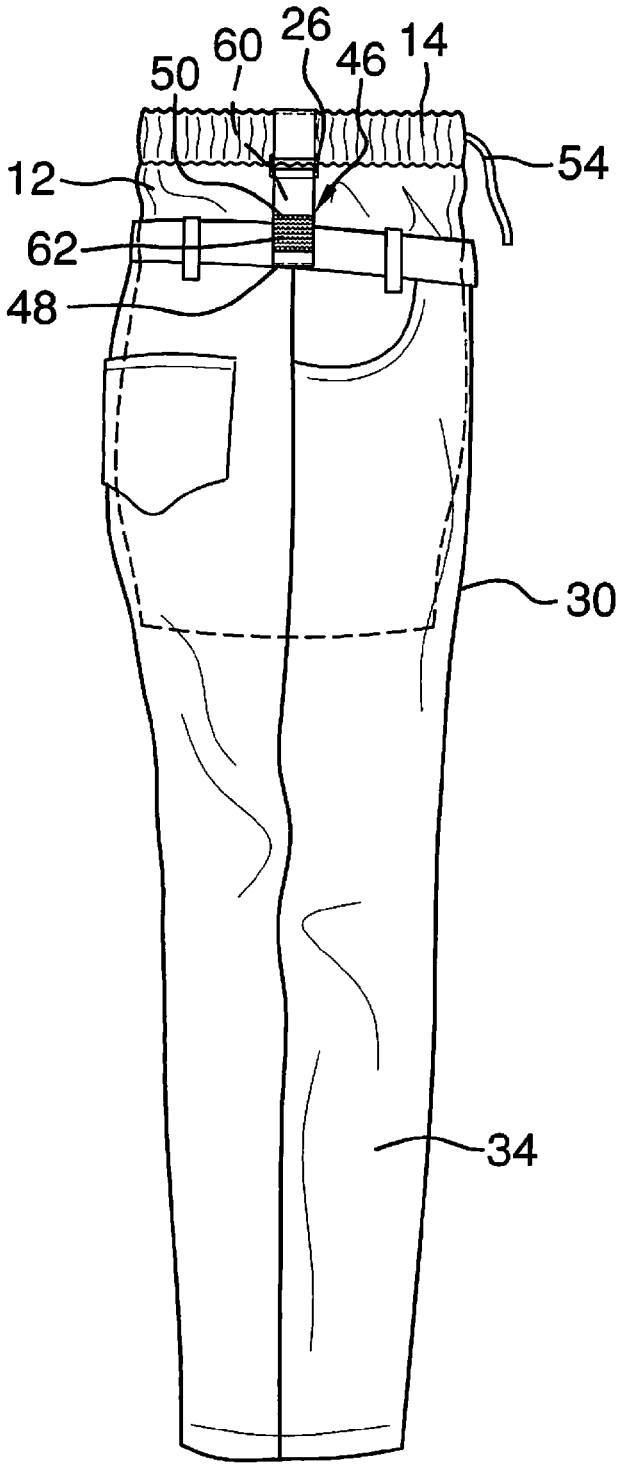
FIG. 5 is a side view of an embodiment of the disclosure.
Figure 6:
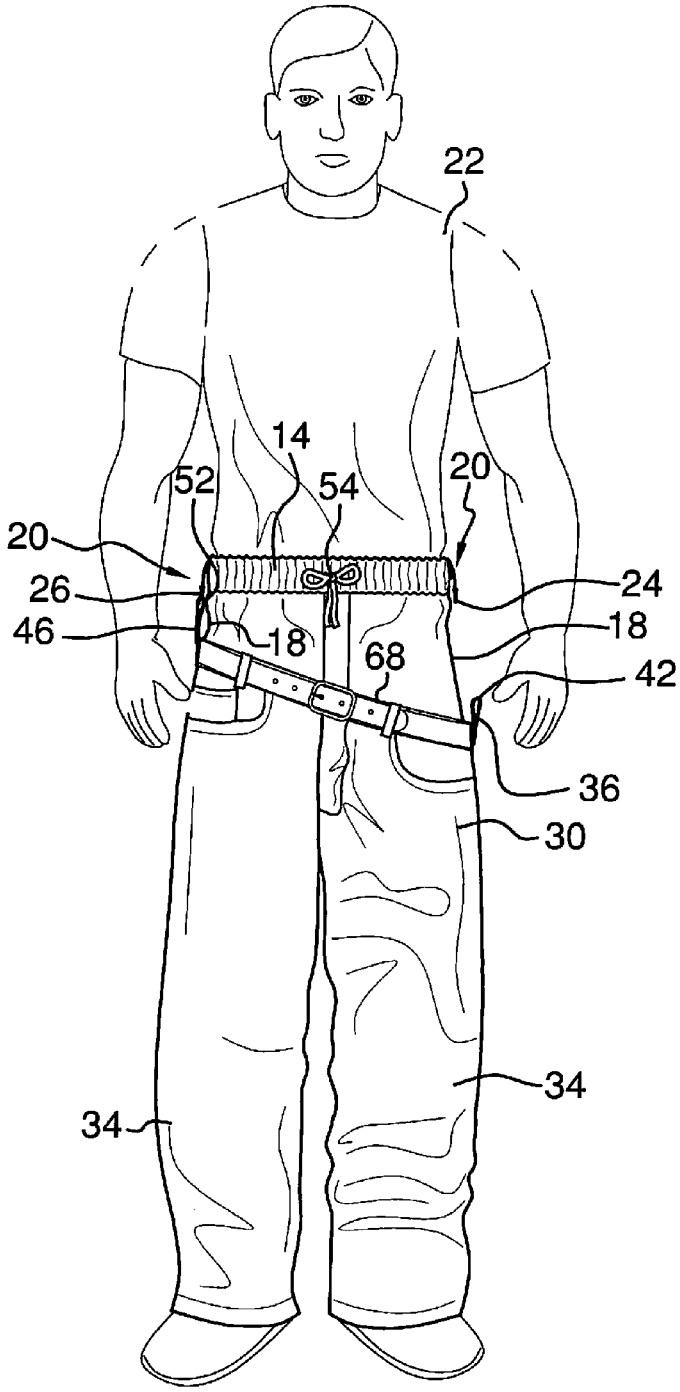
FIG. 6 is a front view of an embodiment of the disclosure in use.

With reference now to the drawings, and in particular to FIGS. 1 through 7 thereof, a new garment support device embodying the principles and concepts of an embodiment of the disclosure and generally designated by the reference numeral 10 will be described.

As best illustrated in FIGS. 1 through 7, the anchored garment assembly 10 generally comprises an inner garment 12, typically underwear, having a waistband 14 and a pair of leg openings 16. The inner garment 12 also has a pair of sides 18 configured for positioning adjacent to a pair of hips 20 of a wearer 22. A support loop 24 is coupled to the inner garment 12 and may be coupled directly to the waistband 14 of the inner garment 12. A support ring 26 is coupled to the inner garment 12 and may also be coupled directly to the waistband 14 of the inner garment 12. The support loop 24 and the support ring 26 are each aligned with an associated one of the sides 18 of the inner garment 12. A drawstring 54 may be coupled to and extend through the waistband 14 of the inner garment 12. Additional support may also be provided by the waistband 14 being resilient.

An outer garment 30 has a top edge 68 defining a top opening 32 and a pair of leg portions 34 extending downwardly from the upper opening 32. A first strap 36 is provided having a first end 38, a second end 40, and a medial portion 42 extending between the first end 38 of the first strap 36 and the second end 40 of the first strap 36. The first end 38 of the first strap 36 is coupled to the outer garment 30. The medial portion 42 of the first strap 36 is selectively extendable through the support loop 24. The second end 40 of the first strap 36 is coupled to the outer garment 30 whereby the top edge 68 of the outer garment 30 is supported by the first strap 36 in spaced relationship to the waistband 14 of the inner garment 12. Thus, a portion of the inner garment 12 will be exposed above the outer garment 30 as may be considered fashionable or otherwise desirable to the wearer 22. A second strap 46 may also be provided having a first end 48, a second end 50, and a medial portion 52 extending between the first end 48 of the second strap 46 and the second end 50 of the second strap 46. The first end 48 of the second strap 46 is coupled to the outer garment 30. The medial portion 52 of the second strap 46 is selectively extendable through the support ring 26. The second end 50 of the second strap 46 is coupled to the outer garment 30 whereby the top edge 68 of the outer garment 30 is further supported by the second strap 46 in spaced relationship to the waistband 14 of the inner garment 12.

A first portion of hook and loop fastener 56 is coupled to the first strap 36 adjacent to the second end 40 of the first strap 36. A second portion of hook and loop fastener 58 is also coupled to the first strap 36. The second portion of hook and loop fastener 58 coupled to the first strap 36 is positioned between the first portion of hook and loop fastener 56 and the first end 38 of the first strap 36. The second portion of hook and loop fastener 58 coupled to the first strap 36 is complimentary to the first portion of hook and loop fastener 56 coupled to the first strap 36 whereby the second end 40 of the first strap 36 is securable to the first portion of hook and loop fastener 56 coupled to the first strap 36.

Similarly, a first portion of hook and loop fastener 60 is coupled to the second strap 46. The first portion of hook and loop fastener 60 coupled to the second strap 46 is positioned adjacent to the second end 50 of the second strap 46. A second portion of hook and loop fastener 62 is coupled to the second strap 50 and is positioned between the first portion of hook and loop fastener 60 coupled to the second strap 46 and the first end 48 of the second strap 46. The second portion of hook and loop fastener 62 coupled to the second strap 46 is complimentary to the first portion of hook and loop fastener 60 coupled to the second strap 46 whereby the second end 50 of the second strap 46 is securable to the first portion of hook and loop fastener 60 coupled to the second strap 46.

Figure 7:
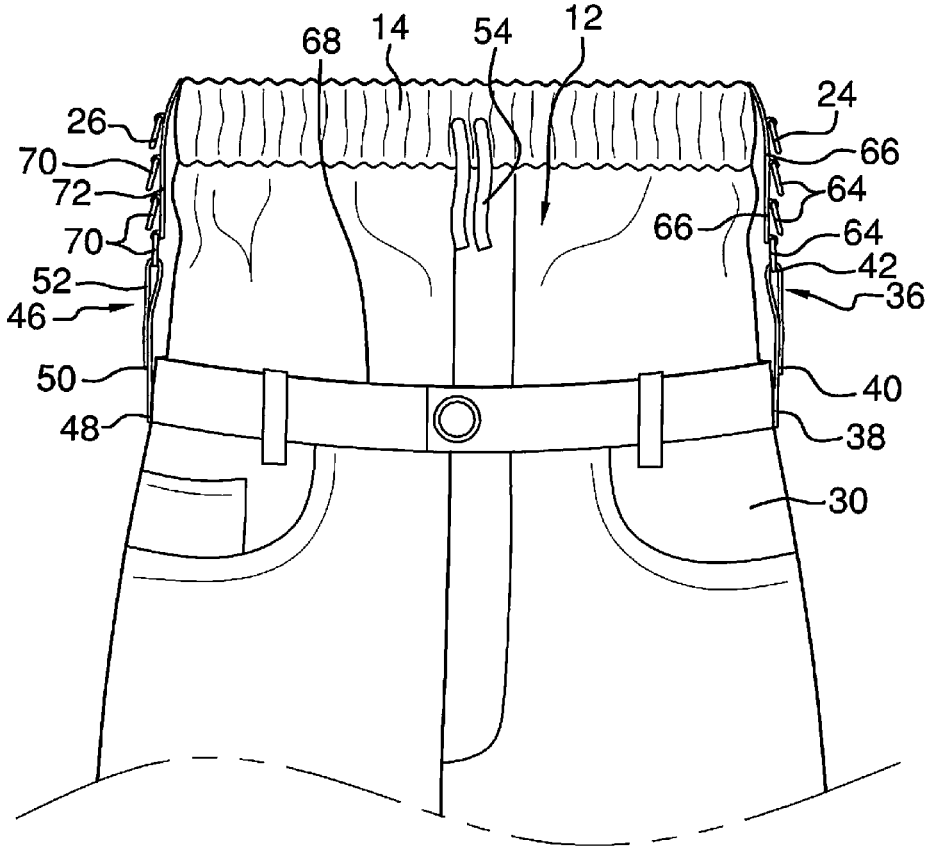
FIG. 7 is a front view of an embodiment of the disclosure.

As shown in FIG. 7, a plurality of aligned supplemental support loops 64 may be coupled to the inner garment 12 using a band 66 extending from the inner garment 12. The supplemental support loops 64 are positioned in spaced relationship to each other extending downwardly from the support loop 24. Thus, the first strap 36 is couplable to a selectable one of the support loop 24 and the supplemental support loops 64 to adjust spacing between the waistband 14 of the inner garment 12 and the top edge 68 of the outer garment 30. A plurality of aligned supplemental support rings 70 may also be coupled to the inner garment 12. The supplemental support rings 70 are positioned in spaced relationship extending downwardly from the support ring 26 by a second band 72. Thus, the second strap 46 is couplable to a selectable one of the support rings 70 to adjust spacing between the waistband 14 of the inner garment 12 and the top edge 68 of the outer garment 30. The supplemental support loops 64 and supplemental support rings 70 may also be laterally aligned with respect to each other such that the top edge 68 of the outer garment 30 may be held at a substantially level or horizontal position if so desired.

In use, the inner garment 12 is worn by the wearer 22 and the waistband 14 adjusted and secured in a desired position relative to a waist 76 of the wearer 22. The outer garment 30 is then put on the wearer 22 and secured to the inner garment 12 using either or both of the first strap 36 and the second strap 46. The first strap 36 and the second strap 46 may also be coupled to the inner garment in such a manner as to skew the top edge 68 of the outer garment 30 if so desired by the wearer 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An anchored garment assembly comprising:

an inner garment having a waistband and a pair of leg openings;

a support loop coupled to said inner garment;

an outer garment having a top edge defining an upper opening and a pair of leg portions extending downwardly from said upper opening;

a first strap having a first end, a second end, and a medial portion extending between said first end of said first strap and said second end of said first strap, said first end of said first strap being coupled to said outer garment, said medial portion of said first strap extending through said support loop, said second end of said first strap being coupled to said outer garment whereby said top edge of said outer garment is supported by said first strap in spaced relationship to said waistband of said inner garment;

a plurality of aligned supplemental support loops coupled to said inner garment, said supplemental support loops being positioned in spaced relationship extending downwardly from said support loop.

2. The assembly of claim 1, further comprising:

a support ring coupled to said inner garment; and a second strap having a first end, a second end, and a medial portion extending between said first end of said second strap and said second end of said second strap, said first end of said second strap being coupled to said outer garment, said medial portion of said second strap extending through said support ring, said second end of said second strap being coupled to said outer garment whereby said top edge of said outer garment is supported by said second strap in spaced relationship to said waistband of said inner garment.

3. The assembly of claim 1, further including said support loop being coupled to said waistband of said inner garment.

4. The assembly of claim 2, further including said support ring being coupled to said waistband of said inner garment.

5. The assembly of claim 1, further including a drawstring coupled to and extending through said waistband of said inner garment.

6. The assembly of claim 2, further including said inner garment having a pair of sides configured for positioning adjacent to a pair of hips of a wearer, said support loop and said support ring each being aligned with an associated one of said sides of said inner garment.

7. The assembly of claim 1, further comprising:

a first portion of hook and loop fastener being coupled to said first strap, said first portion of hook and loop fastener coupled to said first strap being positioned adjacent to said second end of said first strap; and a second portion of hook and loop fastener being coupled to said first strap, said second portion of hook and loop fastener coupled to said first strap being positioned between said first portion of hook and loop fastener coupled to said first strap and said first end of said first strap, said second portion of hook and loop fastener coupled to said first strap being complimentary to said first portion of hook and loop fastener coupled to said first strap whereby said second end of said first strap is securable to said second portion of hook and loop fastener coupled to said first strap.

8. The assembly of claim 2, further comprising:

a first portion of hook and loop fastener coupled to said second strap, said first portion of hook and loop fastener coupled to said second strap being positioned adjacent to said second end of said second strap; and a second portion of hook and loop fastener coupled to said second strap, said second portion of hook and loop fastener coupled to said second strap being positioned between said first portion of hook and loop fastener coupled to said second strap and said first end of said second strap, said second portion of hook and loop fastener coupled to said second strap being complimentary to said first portion of hook and loop fastener coupled to said second strap whereby said second end of said second strap is securable to said second portion of hook and loop fastener coupled to said second strap.

9. The assembly of claim 2, further including a plurality of aligned supplemental support rings coupled to said inner garment, said supplemental support rings being positioned in spaced relationship extending downwardly from said support ring.

10. An anchored garment assembly comprising:

an inner garment having a waistband and a pair of leg openings, said inner garment having a pair of sides configured for positioning adjacent to a pair of hips of a wearer;

a support loop coupled to said inner garment, said support loop being coupled to said waistband of said inner garment;

a support ring coupled to said inner garment, said support ring being coupled to said waistband of said inner garment, said support loop and said support ring each being aligned with an associated one of said sides of said inner garment;

an outer garment having a top edge defining an upper opening and a pair of leg portions extending downwardly from said upper opening;

a first strap having a first end, a second end, and a medial portion extending between said first end of said first strap and said second end of said first strap, said first end of said first strap being coupled to said outer garment, said medial portion of said first strap extending through said support loop, said second end of said first strap being coupled to said outer garment whereby said top edge of said outer garment is supported by said first strap in spaced relationship to said waistband of said inner garment;

a second strap having a first end, a second end, and a medial portion extending between said first end of said second strap and said second end of said second strap, said first end of said second strap being coupled to said outer garment, said medial portion of said second strap extending through said support ring, said second end of said second strap being coupled to said outer garment whereby said top edge of said outer garment is supported by said second strap in spaced relationship to said waistband of said inner garment;

a drawstring coupled to and extending through said waistband of said inner garment;

a first portion of hook and loop fastener being coupled to said first strap, said first portion of hook and loop fastener coupled to said first strap being positioned adjacent to said second end of said first strap;

a second portion of hook and loop fastener being coupled to said first strap, said second portion of hook and loop fastener coupled to said first strap being positioned between said first portion of hook and loop fastener coupled to said first strap and said first end of said first strap, said second portion of hook and loop fastener coupled to said first strap being complimentary to said first portion of hook and loop fastener coupled to said first strap whereby said second end of said first strap is securable to said second portion of hook and loop fastener coupled to said first strap;

a first portion of hook and loop fastener coupled to said second strap, said first portion of hook and loop fastener coupled to said second strap being positioned adjacent to said second end of said second strap;

a second portion of hook and loop fastener coupled to said second strap, said second portion of hook and loop fastener coupled to said second strap being positioned between said first portion of hook and loop fastener coupled to said second strap and said first end of said second strap, said second portion of hook and loop fastener coupled to said second strap being complimentary to said first portion of hook and loop fastener coupled to said second strap whereby said second end of said second strap is securable to said second portion of hook and loop fastener coupled to said second strap;

a plurality of aligned supplemental support loops coupled to said inner garment, said supplemental support loops being positioned in spaced relationship extending downwardly from said support loop; and a plurality of aligned supplemental support rings coupled to said inner garment, said supplemental support rings being positioned in spaced relationship extending downwardly from said support ring.

* * * * *